US005341163A

United States Patent [19]

Hanabusa

[11] Patent Number: 5,341,163

[45] Date of Patent: Aug. 23, 1994

[54] INK JET RECORDING APPARATUS WITH WASTE-PREVENTING RECOVERY OPERATION

[75] Inventor: Tadashi Hanabusa, Yokohama, Japan

[73] Assignee: Canon Kabushiki Kaisha, Tokyo, Japan

[21] Appl. No.: 950,228

[22] Filed: Sep. 24, 1992

[30] Foreign Application Priority Data

Sep. 30, 1991 [JP] Japan ..... 3-251884

[51] Int. Cl.[5] ..... B41J 2/165

[52] U.S. Cl. ..... 347/23; 347/30

[58] Field of Search ..... 346/140 C, 75; 400/126

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,608,577 | 8/1986 | Hori | 346/140 R |
| 4,723,129 | 2/1988 | Endo et al. | 346/1.1 |
| 4,740,796 | 4/1988 | Endo et al. | 346/1.1 |
| 4,947,187 | 8/1990 | Iwagami | 346/140 R |
| 4,967,204 | 10/1990 | Terasawa et al. | 346/140 R |
| 5,132,710 | 7/1992 | Ejiri et al. | 346/140 R |
| 5,583,333 | 12/1985 | Sugitani et al. | 346/140 R |

FOREIGN PATENT DOCUMENTS

| | | | |
|---|---|---|---|
| 54-056847 | 5/1979 | Japan . | |
| 59-123670 | 7/1984 | Japan . | |
| 59-138461 | 8/1984 | Japan . | |
| 0199954 | 9/1986 | Japan . | |
| 0249759 | 11/1986 | Japan | 346/140 R |
| 0077940 | 4/1987 | Japan | 346/140 R |

*Primary Examiner*—Benjamin R. Fuller
*Assistant Examiner*—N. Le
*Attorney, Agent, or Firm*—Fitzpatrick, Cella, Harper & Scinto

[57] ABSTRACT

An ink jet recording apparatus has a recovery unit designed to reduce the possibility of an ink droplet ejection failure or malfunction and to enable stable recording even if the recording head is left for a long period of time without being tightly covered with a cap. The recovery unit is controlled in such a manner that it is operated to perform an ejection recovery operation if a detector detects that the cap is not covering the nozzle of the recording head when the power source of the ink jet recording apparatus is turned on, and the recovery unit is not operated if the detector detects that the cap is covering the nozzle of the recording head when the power source is turned on. Accordingly, the ejection recovery operation is automatically performed if the operator cuts off the power supply during recording or when the recording head is not covered tightly with the cap, then leaves the apparatus in this state for a long time and thereafter starts recording. However, the ejection recovery operation is not performed if the recording head is tightly capped when the power source is turned on, thus avoiding needlessly wasting ink by performing an unnecessary recovery operation.

11 Claims, 15 Drawing Sheets

INK JET RECORDING APPARATUS WITH WASTE-PREVENTING RECOVERY OPERATION

BACKGROUND OF THE INVENTION

1. Field of the Invention

This invention relates to an ink jet recording apparatus and, more particularly, to an ink jet recording apparatus capable of reducing the possibility of an ink droplet ejection failure or malfunction and capable of performing recording with stability. The recording apparatus of the present invention can be applied to various office machines and communication apparatuses, such as electronic typewriters, word processors, copying machines, facsimile machines and computers.

2. Description of the Prior Art

Conventionally, recording apparatuses for recording on recording mediums, such as paper and overhead projector sheets (hereinafter referred to as recording sheets), have used recording heads that operate in accordance with various recording methods, such as wire dot methods, thermosensing methods, thermal transfer methods and ink jet methods. Ink jet methods, in which ink is directly jetted to a recording sheet, have attracted attention because they have a Low running cost and provide a low-noise recording operation.

In recent years, film-forming techniques and micromachining techniques for manufacturing semiconductor devices have been applied to the manufacture of ink jet recording apparatuses and, in particular, to ink jet recording heads, so that smaller and lower-priced recording heads are now being developed. Throw-away type recording heads integrally combined with ink tanks have also been provided. With such recording heads, smaller and simpler recording apparatuses are possible.

On the other hand, ink jet recording units having the above-described various advantages are being widely used as recording units of various kinds of apparatuses, such as electronic typewriters, word processors, facsimile machines and copying machines. Ink jet recording units for use in such apparatuses are designed to have constructions corresponding to the specific functions and modes of use of the respective apparatuses. Also, with respect to electronic typewriters, word processors and the like, there is a design trend to smaller, lighter and portable machines. In this respect as well, it is desirable to design smaller ink jet recording units with simpler constructions for use in these kinds of recording apparatuses.

Ordinarily, ink jet type recording apparatuses have a recording head with an array of fine ejection holes and are therefore designed to perform a process for removing the cause of an ejection failure (ejection recovery process), for example, in a case where air bubbles or dust particles enter the ejection holes or the state of the ink is changed by an increase in the viscosity caused by evaporation of the ink solvent so as to be unsuitable for recording. A means for performing such an ejection recovery process is known which includes a cap capable of covering the surface of the recording head in which the ejection holes are formed and serving as an ink receiver, and a pump communicating with this cap and capable of producing a suction force.

In an ink jet recording apparatus using such a means, ink is ejected by driving energy generation elements inside the ejection holes, while the cap is set so as to face the ejection hole formation surface, or ink is drawn from the ejection holes to remove the cause of an ejection failure by operating the pump to produce a suction force inside the cap while it is covering the ejection hole formation surface.

The operation of covering the ejection hole formation surface with the cap is typically performed by moving a carriage on which the recording head is mounted to a home position when recording is finished, and then bringing the cap, which is capable of advancing or retreating at this home position, into abutment against the recording head so as to cover the ejection hole surface.

A waste ink tank for storing waste ink produced by the ejection recovery process is provided at a suitable position in the apparatus. To force ink received in the ejection recovery system (the cap, the pump and a waste ink tube for communication between the cap and the pump) during the ejection recovery process into the waste ink tank, an operation called idle drawing is performed by operating the pump while the cap is open to the atmosphere to draw ink together with air into the ejection recovery system. If waste ink introduced into the ejection recovery system by an ejection recovery process is left therein, it may solidify or leak from the cap to the outside. The idle drawing operation is effective in preventing such a problem.

If the operator turns off the power source for the apparatus during recording or when the recording head is completely closed with the cap, and if the apparatus is left in this state for a long time, the ejection holes of the recording head can be clogged by an increase in the viscosity of ink in the ejection holes, which causes an ink droplet ejection failure or malfunction when the apparatus is used again, thus resulting in a deterioration in printing quality. To avoid this problem, an ejection recovery operation may be performed automatically by drawing ink through the ejection holes each time the power source is turned on. However, if that is done every time the power source is turned on, the ink consumption rate is considerably increased, resulting in an increase in running cost, particularly if the power source is turned on and off frequently.

Also, the recording apparatus may be arranged in such a manner that a "soft switch" is provided as a main switch of the apparatus. Then, if the main switch is turned off while the head is not capped, the apparatus performs a power-off sequence to cut the power supply only after the ejection holes have been completely closed with the cap. In this case, however, the control process is made complicated by the necessity of using a soft switch, so that manufacturing cost is increased. Moreover, even if such a soft switch is provided, it is still possible in some circumstances that the power-off sequence will not be started and the apparatus will be left for a long time without closing the ejection holes with the cap, for example, if the AC power supply to the apparatus is cut by disconnecting the plug from the wall outlet instead of turning off the main switch.

SUMMARY OF THE INVENTION

In view of the above-described problems, an object of the present invention is to provide an ink jet recording apparatus capable of reducing the possibility of an ink droplet ejection failure or malfunction and capable performing recording with stability.

To achieve this object, according to one aspect of the present invention, there is provided an ink jet recording apparatus for recording using a recording head for ejecting ink onto a recording medium through a nozzle, the apparatus comprising cap means capable of assuming an open state for opening the nozzle of the recording head and a closed state for closing the nozzle of the recording head, ejection recovery means for performing an ejection recovery operation on the recording head to recover the ink ejection from the nozzle, time count means for counting the time elapsed from an ejection recovery operation, detection means for detecting the state of the cap means if the time elapsed from a preceding ejection recovery operation is performed to the time a power source for the recording apparatus is turned on is shorter than a predetermined length of time, and control means for controlling the ejection recovery means so that the an ejection recovery operation is performed if the detection means detects that the cap means is in the open state when the power source is turned on, and for controlling the ejection recovery means so that an ejection recovery operation is not performed if the detection means detects that the cap means is in the closed state when the power source is turned on.

According to another aspect of the present invention, there is provided an ink jet recording apparatus for recording using a recording head for ejecting ink onto a recording medium through a nozzle, the apparatus comprising cap means capable of assuming an open state for opening the nozzle of the recording head and a closed state for closing the nozzle of the recording head, ejection recovery means for performing an ejection recovery operation on the recording head to recover the ink ejection from the nozzle, detection means for detecting the state of the cap means, and control means for controlling the ejection recovery means so that an ejection recovery operation is performed if the detection means detects that the cap means is in the open state when a power source for the recording apparatus is turned on, and for controlling the ejection recovery means so that an ejection recovery operation is not performed if the detection means detects that the cap means is in the closed state when the power source is turned on.

In accordance with the present invention, the head ejection recovery operation is automatically performed, if the operator cuts off the power supply during recording or when the recording head is not covered tightly by the cap, then leaves the apparatus in this state for a long time and thereafter starts recording. It is thereby possible to avoid ink droplet ejection failure or malfunction due to an increase in the viscosity of ink or clogging in the nozzle, thus enabling suitable image recording. The apparatus is also arranged to have a mode in which the ejection recovery operation is inhibited if the recording head is capped when the power source is turned on, thereby avoiding wasteful ink consumption.

DESCRIPTION OF THE PREFERRED EMBODIMENTS

Embodiments of the present invention will be described below in detail with reference to the accompanying drawings.

FIRST EMBODIMENT

Figure 1:
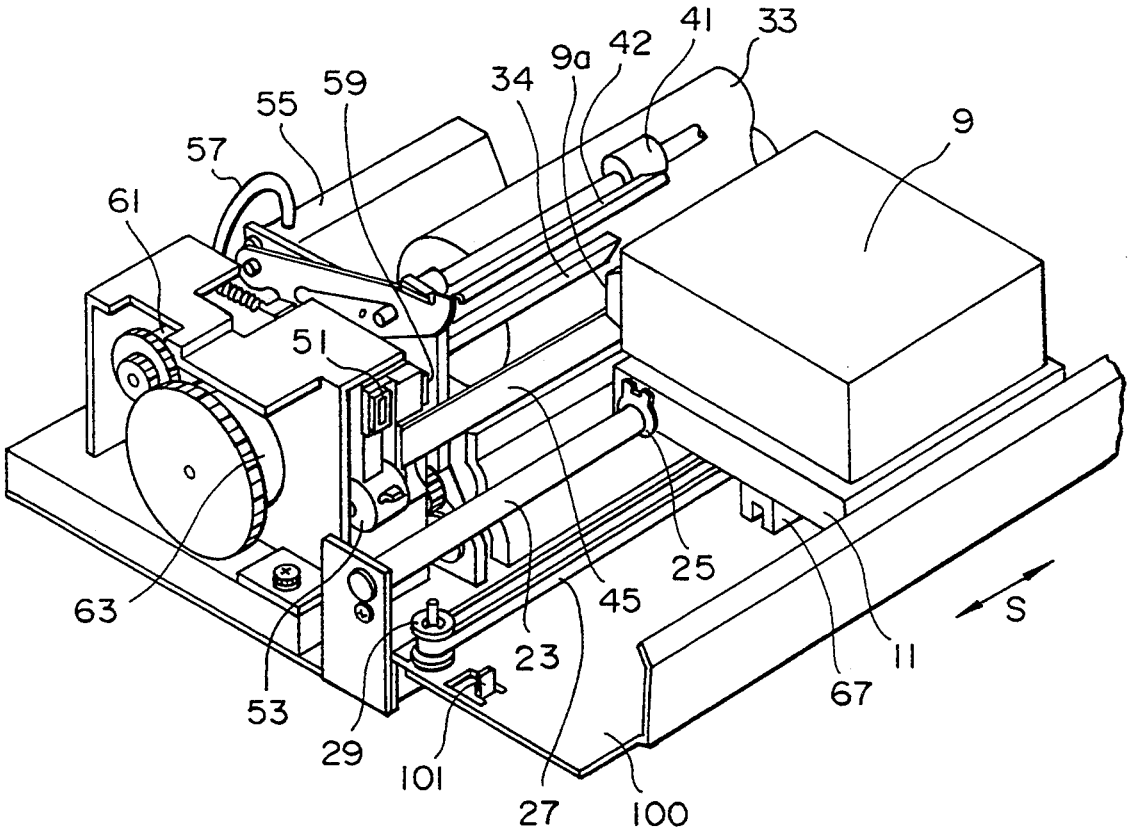
FIG. 1 is an example of a printer unit of an ink jet recording apparatus in accordance with the present invention.

FIG. 1 shows an example of the construction of a printer unit of an ink jet recording apparatus in accordance with the present invention. The printer unit has a head cartridge 9 having an ink jet recording head, and a carriage 11 on which the head cartridge 9 is mounted to be moved for scanning in the direction S. A guide shaft 23 for guiding the carriage 11 in the direction S is inserted in a bearing 25 of the carriage 11. The carriage 11 is fixed to a timing belt 27, and power for moving the carriage 11 in the direction S is transmitted to the timing belt 27. The timing belt 27 is wrapped around pulleys disposed on opposite side portions of the unit. Only one such pulley, pulley 29, is shown. A driving force is transmitted from a carriage motor (not shown) to the pulleys through a gear transmission mechanism or the like. A transport roller 33 serves to limit a recording surface of a recording medium such as a sheet of paper and to transport the recording medium during recording. The transport roller 33 is driven by a transport motor (not shown). A paper guide 34 serves to direct the recording surface of the recording medium in the direction toward an ejection surface of the head cartridge 9.

A paper discharge roller 41 is disposed downstream the recording position and serves to discharge the recording medium toward a paper discharge port (not shown). An arm 42 serves to place a spur (not shown) so that the spur faces the paper discharge roller 41.

The unillustrated spur can press the paper discharge roller 41 through the recording medium to generate a paper transporting force from the discharge roller 41. A paper pressing member 45 serves to limit floating of the like of the recording medium in the vicinity of the recording position so that the recording medium is maintained in close contact with the transport roller 33.

A cap 51 formed of an elastic material such as rubber is disposed so as to be able to face an ink ejection hole formation surface 9*a* of the recording head in a home position. The cap 51 is supported so as to be capable of contacting and moving away from the ink ejection hole formation surface of the recording head to assume open and closed states, respectively. The cap 51 is used to protect the recording head when the recording head is not used and is also used in a recording head ejection recovery process.

In this specification, "ejection recovery process" or "ejection recovery operation" is a process in which the cap 51 is made to face the ink ejection hole formation surface 9*a* of the recording head, and in which energy generation elements provided inside ink ejection holes are driven to eject ink through all the ejection holes (preliminary ejection), or a process in which a suction force is caused by a pump while the ink ejection hole formation surface 9*a* is covered with the cap 51 to draw ink from the ejection holes and remove bubbles, dust, ink increased in viscosity so as to become unsuitable for recording, or the like, i.e., the cause of an ejection failure. The amount of ink consumed by drawing ink through the ejection holes in the ejection recovery process is about 300 times as large as the amount of ink consumed by ejecting ink through the ejection holes by driving the energy generation elements.

A pump 53 is provided as the pump used to produce the suction force and to draw an amount of ink received by the cap 51 during an ejection recovery process. A waste ink tank 55 stores waste ink drawn by the pump 53. A rude 57 provides communication between the pump 53 and the waste ink tank 55. A blade 59 serves to wipe the ejection hole formation surface of the recording head. The blade 59 is supported so as to be capable of moving between a position at which it projects toward the recording head to perform wiping during head movement and a retracted position at which it does not contact the ejection hole formation surface 9*a*. A motor 61 drives the pump 53 and moves the cap 51 and the blade 59 by power transmission through a cam device 63.

Figure 2:
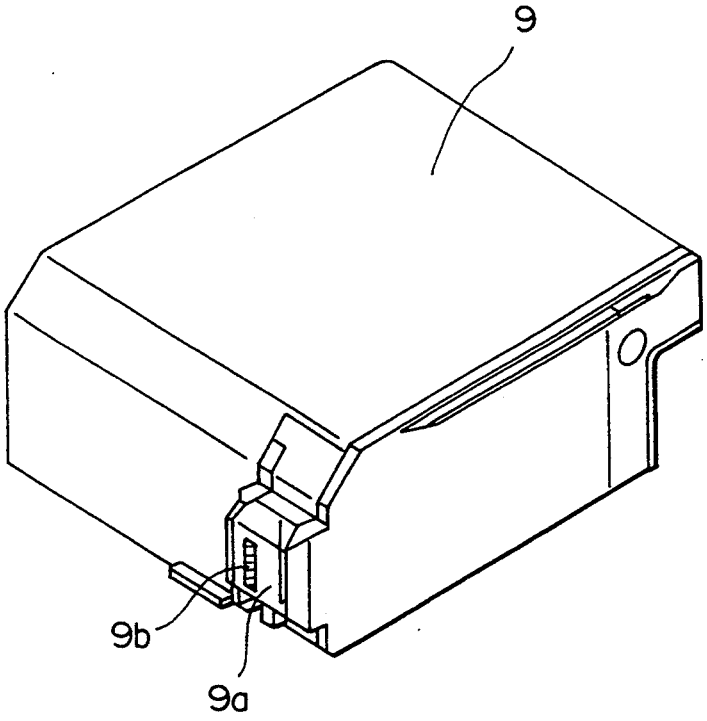
FIG. 2 is a perspective view of a head cartridge.

FIG. 2 is a perspective view of the appearance of the head cartridge 9 with an ink tank. The head cartridge 9 has ink ejection holes 9*b* formed in the ejection hole formation surface 9*a*. The ink ejection holes 9*b* can be completely covered with the cap 51 brought into contact therewith when recording is not performed.

Figure 3:
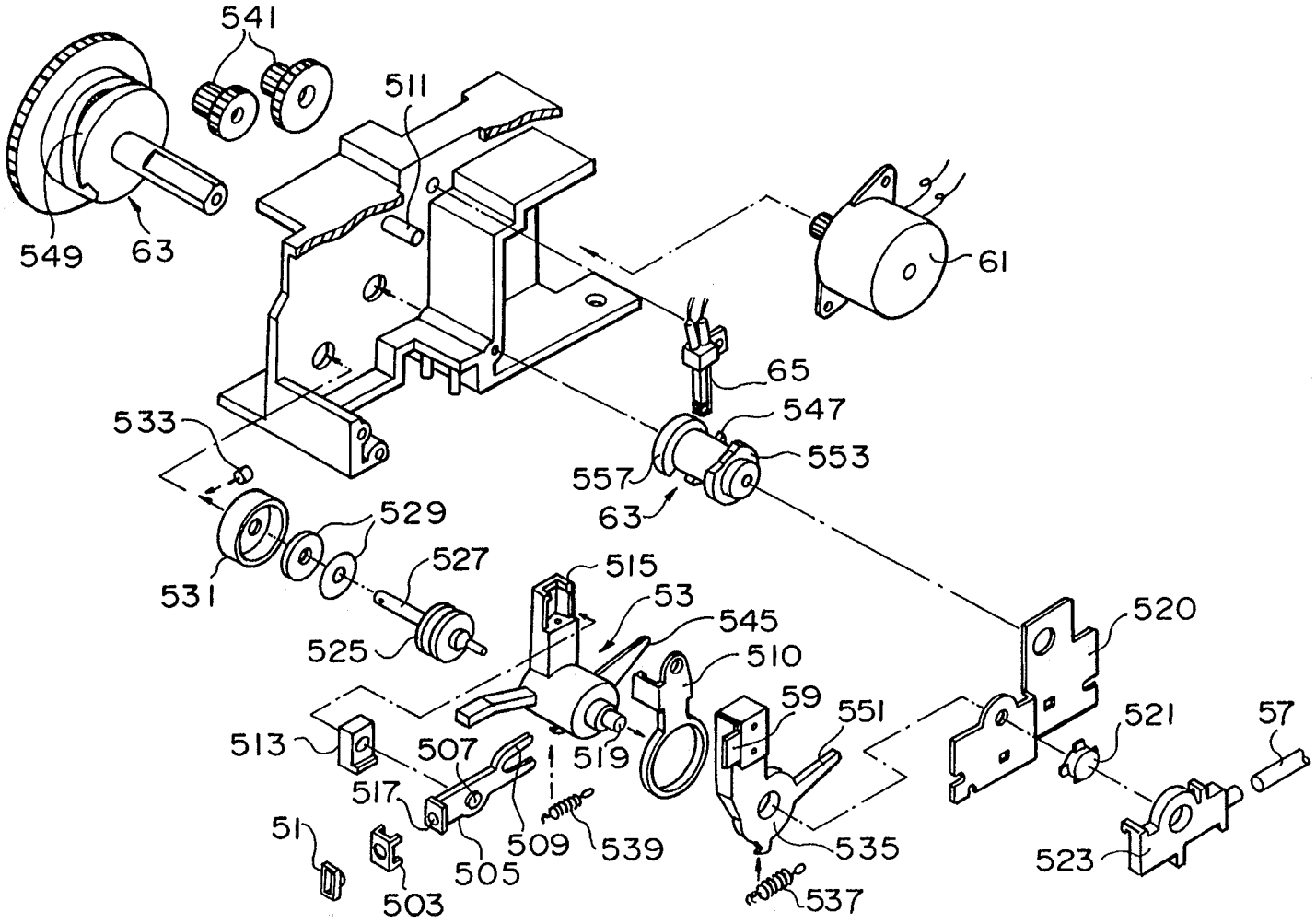
FIG. 3 is an exploded perspective view of a recovery unit.

FIG. 3 is an exploded perspective view of a recovery system unit including the cap 51, the pump 53, the blade 59, the motor 61, the cam device 63 and other components. A member 503 is a holder member for holding the cap 51, and a member 505 is a cap lever which is mounted so as to be rotatable on a pin 507, and which serves to bring the cap 51 into contact with the ejection hole formation surface 9*a* of the cartridge 9 and to move the cap 51 apart from the ejection hole formation surface 9*a* by a force applied to the pin 507. A pin 511 is engaged with ends 509 of the cap lever 505 to limit the range of rotation of the cap lever 505.

Figure 4:
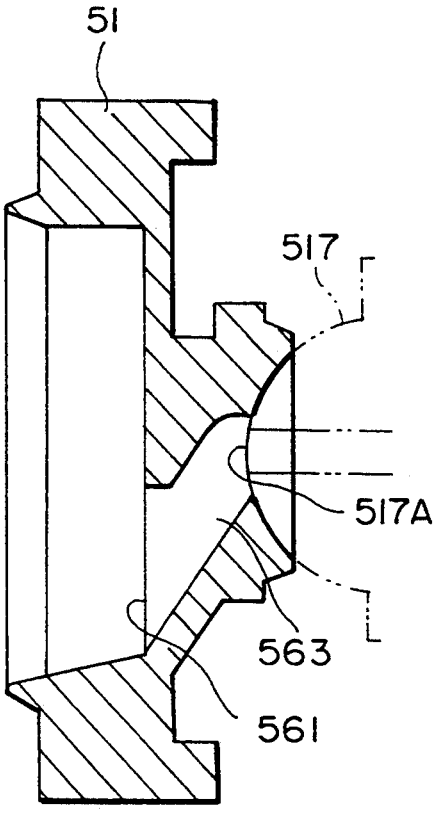
FIG. 4 is a diagram of an example of the construction of a cap.

A jig 513 having a hole in which the pin 507 of the cap lever 505 is fitted is used to mount the cap lever 505 on a support 515 provided on the pump 53. A fastening member 510 serves to maintain the mounted state of the cap lever 505. The cap lever 505 has an operating portion 517 for applying to the cap 51 a force for maintaining the cap 51 in contact with the ejection hole formation surface 9*a* of the recording head. The operating portion 517 is engaged with a generally-central rear side portion of the cap 51. The operating portion 517 has, as shown in FIG. 4, an inlet 517A through which drawn ink is introduced, and an ink flow path is formed in each of the cap lever 505, the pin 507, the jig 513 and the support 515.

When the pump 53 produces the suction force, ink is introduced into the pump 53 through these flow paths as indicated by the arrow. A shaft 519 having an internal ink flow path projects from a central portion of an end surface of the pump 53. The shaft 519 is rotatably fitted in a side wall member 520. A force on the pump 53 which acts to rotate the pump 53 is applied to the cap lever 505 through the support 515, so that the cap 51 advances or retreats. A flow path formation member 521 forms a flow path extending from the flow path formed in the shaft 519 of the pump 53 and bent perpendicularly. An attachment member 523 is a member for attaching a waste ink tube 57. An ink flow path is also formed in the attachment member 523. Ink drawn by the pump 53 is introduced into the ink tank 55 through the flow path formed in the shaft 519, the flow path formation member 521 and the attachment member 523.

The pump 53 has a piston 525, a piston shaft 527, a packing 529, and a cap 531. A pin 533 is attached to the piston shaft 527 to receive a force transmitted to operate the piston 525. A blade lever 535 to which the blade 59 is attached is rotatably supported on the shaft 519 projecting from the end surface of the pump 53. With the rotation of the blade lever 535, the blade 59 projects to or retreats from the recording head. A spring 537 applies a force to the blade lever 535 to rotate the same in the direction of the projection of the blade 59. A spring 539 urges the cap 53 toward the recording head through the rotation of the pump 53.

A gear train 541 transmits the torque of the motor 61 to the cam device 63. The cam device 63 has a cam 547 which engages with an engagement portion 545 formed on the pump 53 to rotate the pump 53, a cam 549 which engages with the pin 533 provided on the piston shaft 527 to operate the pump, a cam 553 which engages with an engagement portion 551 formed on the blade lever 535 to rotate the blade lever 535, and a cam 557 which engages with a recovery system home sensor 65 for detecting a home position of the cam device 63. The operation of these cams will be described later.

FIG. 4 shows an example of the construction of the cap 51. In the cap 51, an ink drawing hole 561 is opened in a vertically-lower portion of the cap 51, and an ink flow path 563 is formed so as to extend from this hole to the ink inlet 517A formed in the operating portion 517 of the cap lever 505.

Figure 5:
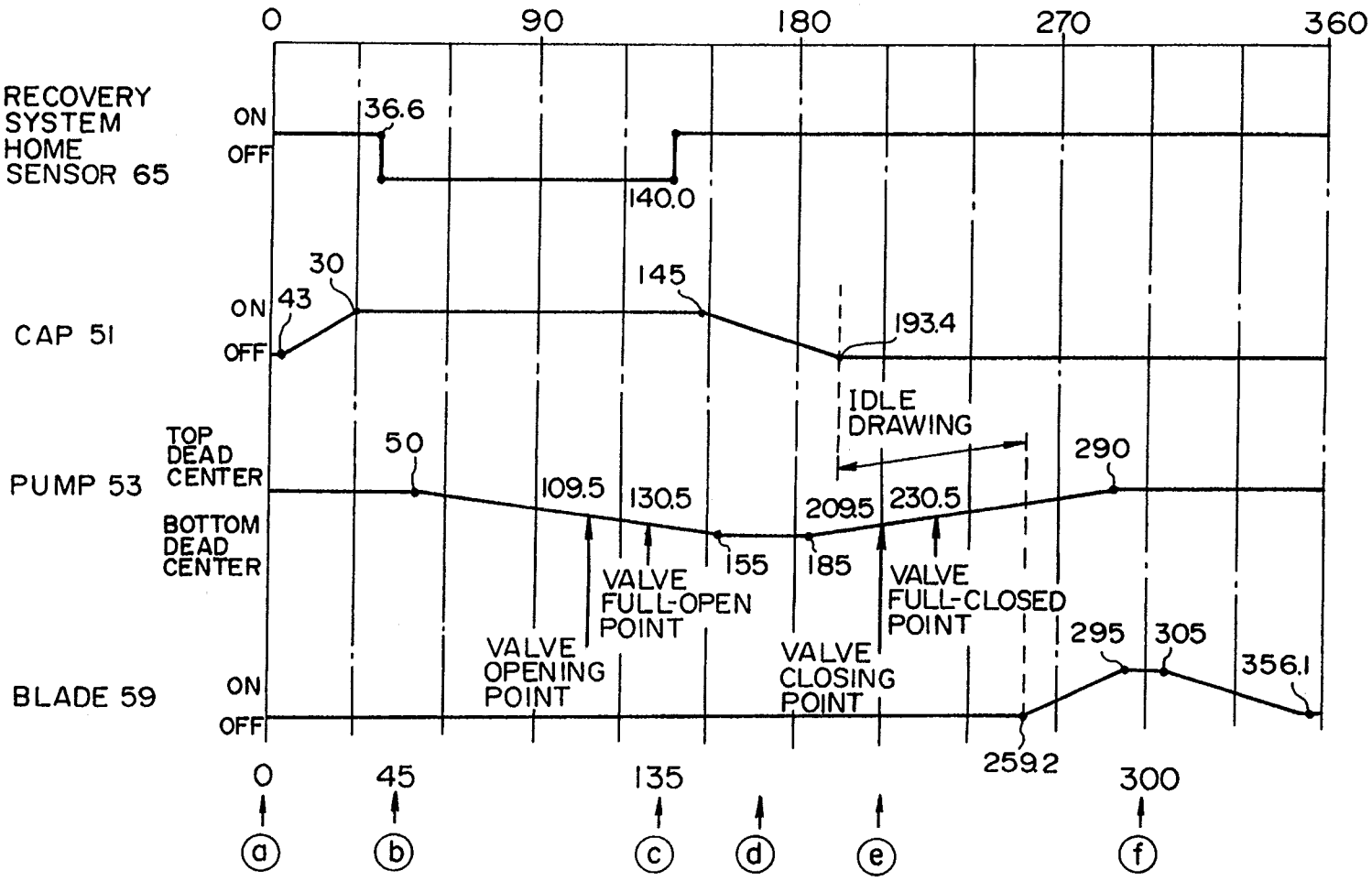
FIG. 5 is a diagram of cam profile lines of a cam device.
Figure 6:
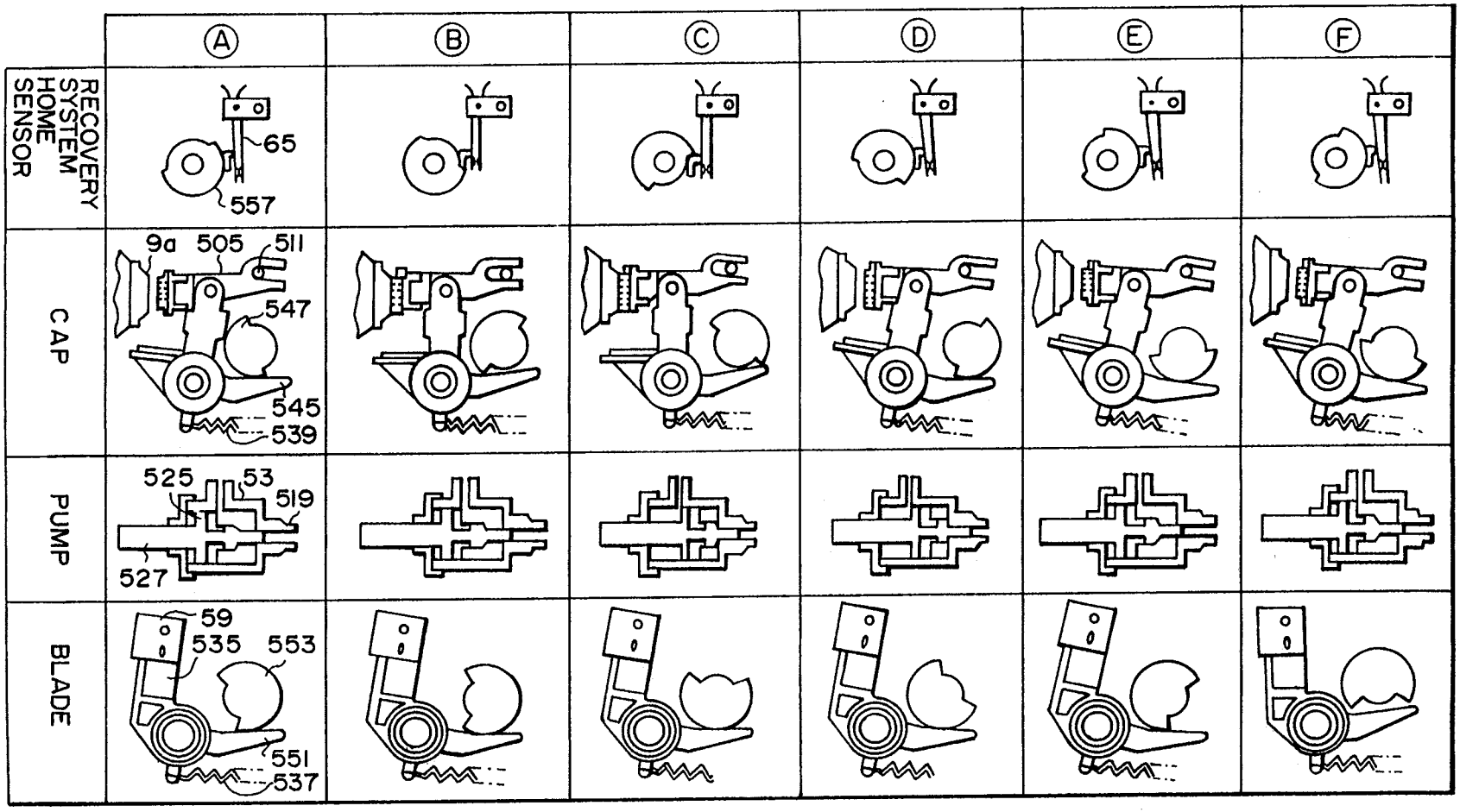
FIG. 6 is a diagram of the positions of operating components with respect to the position of the cam device.

FIGS. 5 and 6 are diagrams showing the profile lines of the cams of the cam device 63 and the operating positions of the operating members with respect to the cam position. Numerical values shown in FIG. 5 represent cam rotation angles. In FIGS. 5 and 6, letters (a) and (A) indicate the cam positions and the state of the members when the recording operation is performed. At this cam position, the cap 51 and the blade 59 are separated from the ejection hole formation surface 9a of the recording head, and the pump 53 is at the top dead center. Letters (b) and (B) indicate the position at which the recovery system home sensor 65 is off. This position is referred to as a home position of the cam device 63. This position is set at the time of recording waiting or the like. At this time, the cap 51 contacts and covers the ejection hole formation surface 9a, the blade is retreated, and the pump 53 is at the top dead center. As the cam device 63 rotates from the position (b), the piston 525 is moved toward the bottom dead center, while the cap 51 is maintained in the state of being joined to the ejection hole formation surface (cap-on state), so that the negative pressure provided by the suction system in the cap becomes greater.

After a period of time in which the piston 525 reaches and closes the ink inlet port of the pump (the valve closing period), the valve starts opening (at a point of 109.5°) and becomes fully open (at a point of 130.5°), and the piston 525 thereafter reaches the position (c) in the vicinity of the bottom dead center. Because of the flow resistance of the ink recovery system, the rotation of the cam device is stopped for a predetermined time at this position to draw the maximum amount of ink. As the cam device is thereafter rotated, the piston 525 reaches the bottom dead center and the cap 51 starts moving apart from the ejection hole formation surface. This state corresponding to the position (d) is maintained for a predetermined time.

Thereafter, as the cam device is further rotated, the piston 525 starts moving to the top dead center. During this process, the valve starts closing (at a point of 209.5°) and reaches a point at which it is completely closed (a point of 230.5°) , while the cap 51 is completely separated from the ejection hole formation surface at the position (e) . In the vicinity of this position, the piston 525 is driven several times to draw ink remaining in the ink recovery system to the pump (that is, for idle drawing).

The two spaces on the opposite sides of the piston 525 communicate with each other through a flow passage (not shown) which is closed when the piston moves from the top dead center to the bottom dead center, and which is open when the piston moves from the bottom dead center to the top dead center. The space on the right side of the piston communicates with the flow path formed in the pump axis 519. Accordingly, when the piston 525 moves from the bottom dead center to the top dead center during the idle drawing process, ink introduced into the space on the left side of the piston is moved to the space on the right side. When the piston moves from the top dead center to the bottom dead center, ink is introduced into the space on the left side from the ink recovery system and ink in the space on the right side is discharged to the waste ink tank.

Thereafter, as the cam device is further rotated in the positive direction, the blade 59 projects so as to be able to wipe the head (at the position (f)). In this state, as the carriage 11 is moved to the recording region, the blade 59 is engaged with the ejection hole formation surface of the head to wipe off ink and extraneous matter attached to the ejection hole formation surface. Then, the cam device is further rotated to retract the blade 55 to be set in the position (a). In this state, the carriage 11 is moved to the cap side so that the ejection hole formation surface of the head faces the cap 510 The cam device is then moved to the position (b) to cap the ejection hole formation surface, and is stopped. If recording is then started, the cam device is rotated from the position (b) in the positive or negative direction to perform wiping by projecting the blade 59 before recording.

Figure 7:
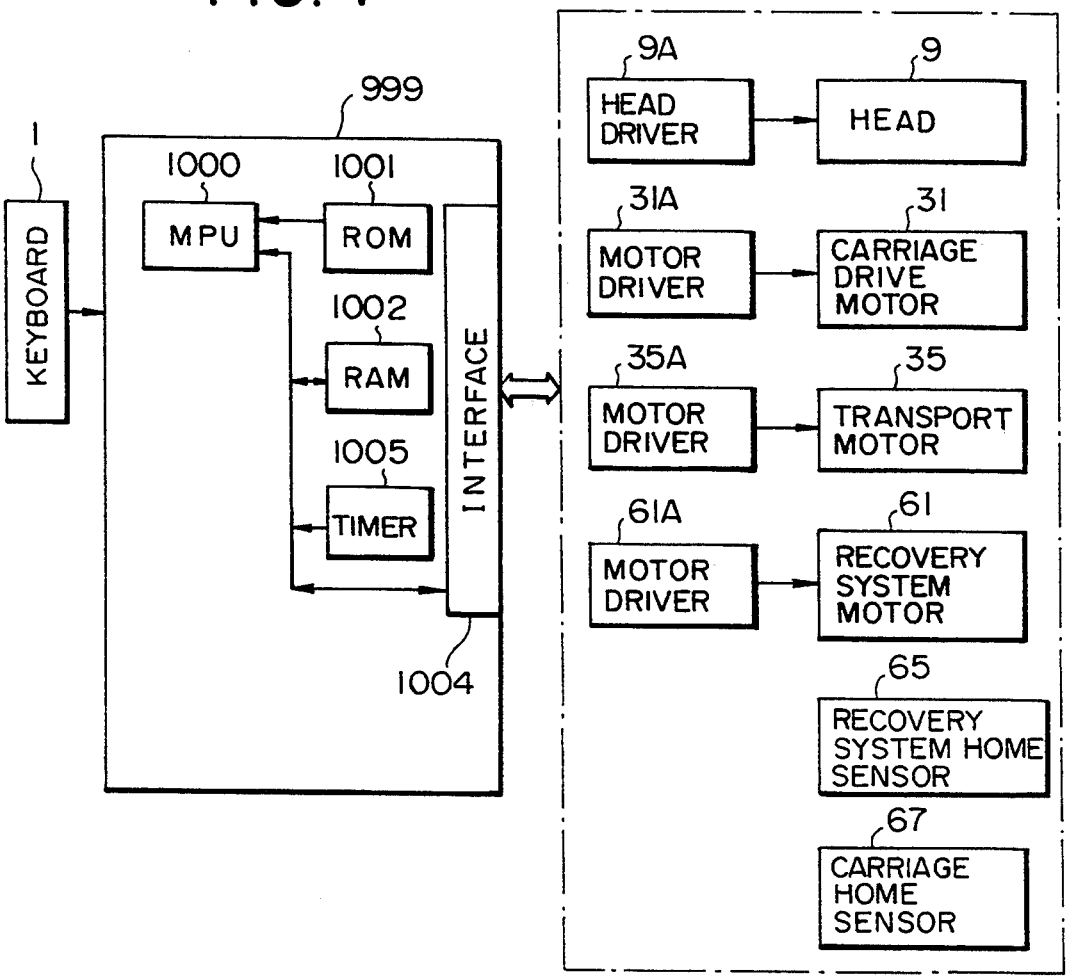
FIG. 7 is a block diagram of an example of a control system of a recording apparatus in accordance with the present invention.
Figure 8:
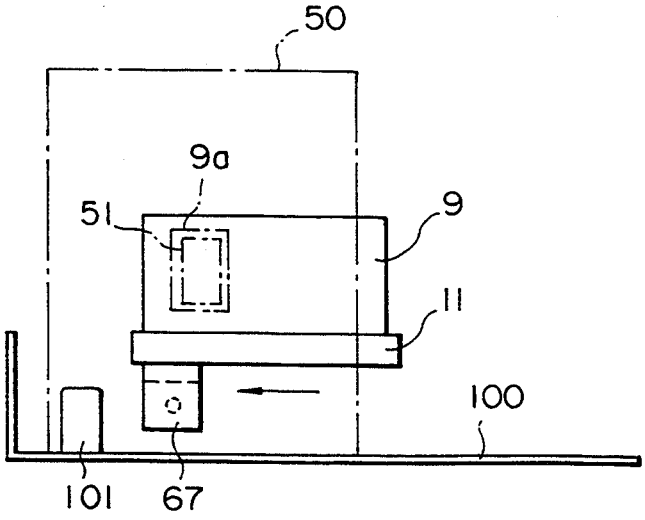
FIG. 8 is a diagram of a positional relationship between a recovery system unit, a carriage and other components.

The construction of a control system of the recording apparatus in accordance with this embodiment will be described below with reference to FIGS. 7 and 8. The capping position and the moving position of the carriage 11 can be known by checking the carriage home sensor 67, which detects arrival of the carriage at the home position. FIG. 8 shows the positional relationship between the carriage 11, the recovery system unit 50 and a plate 101 for shielding the carriage home sensor 67, when the head is capped. There are also illustrated the head 9, the ejection hole formation surface 9a, the cap 51 and a frame 100. The position of the carriage before the power source is turned on can be known by detecting, when the power source is turned on, the number of steps of the carriage driving motor 31 for moving the carriage in the direction of the arrow in FIG. 8 until the carriage home sensor 67 is shielded by the shielding plate 101.

The state of the cam device 63 of the recovery unit can be known by checking the recovery system home sensor 65, which is a contact switch. Inputting for recording can be performed by operating keys provided in a keyboard 1. A block 999 shown in FIG. 7 represents a control means including a microprocessor unit (MPU) 1000 which executes a later-described control process to generate control signals for controlling each operating component. To the MPU 1000 are connected a ROM 1001 in which a program or the like corresponding to the control process is stored, a RAM 1002 used as a working area for executing the control process of the MPU 1000, i.e., a printing data buffer or the like, and a timer 1005 for counting time relating to the ink jet recording apparatus, particularly the time elapsed from completion of an ejection recovery operation. The timer 1005 is backed up by a battery.

Drive sources for the recording apparatus mechanisms, the head 9, the carriage driving motor 31, a transport motor 35, the recovery system motor 61, and so on, are also connected to the MPU 1000 through an interface 1004, a head driver 9A, motor drivers 31A, 35A, and 61A. The driving operations of these drive sources are controlled by the MPU 1000.

Detection signals from the recovery system home sensor 65 and the carriage home sensor 67 are input to the MPU 1000 through the interface 1004. In the control system thus arranged, the MPU 1000 controls the operating components and conducts a printing operating, a head ejection recovery operation and so on by executing the control program stored in the ROM 1001.

Figure 9:
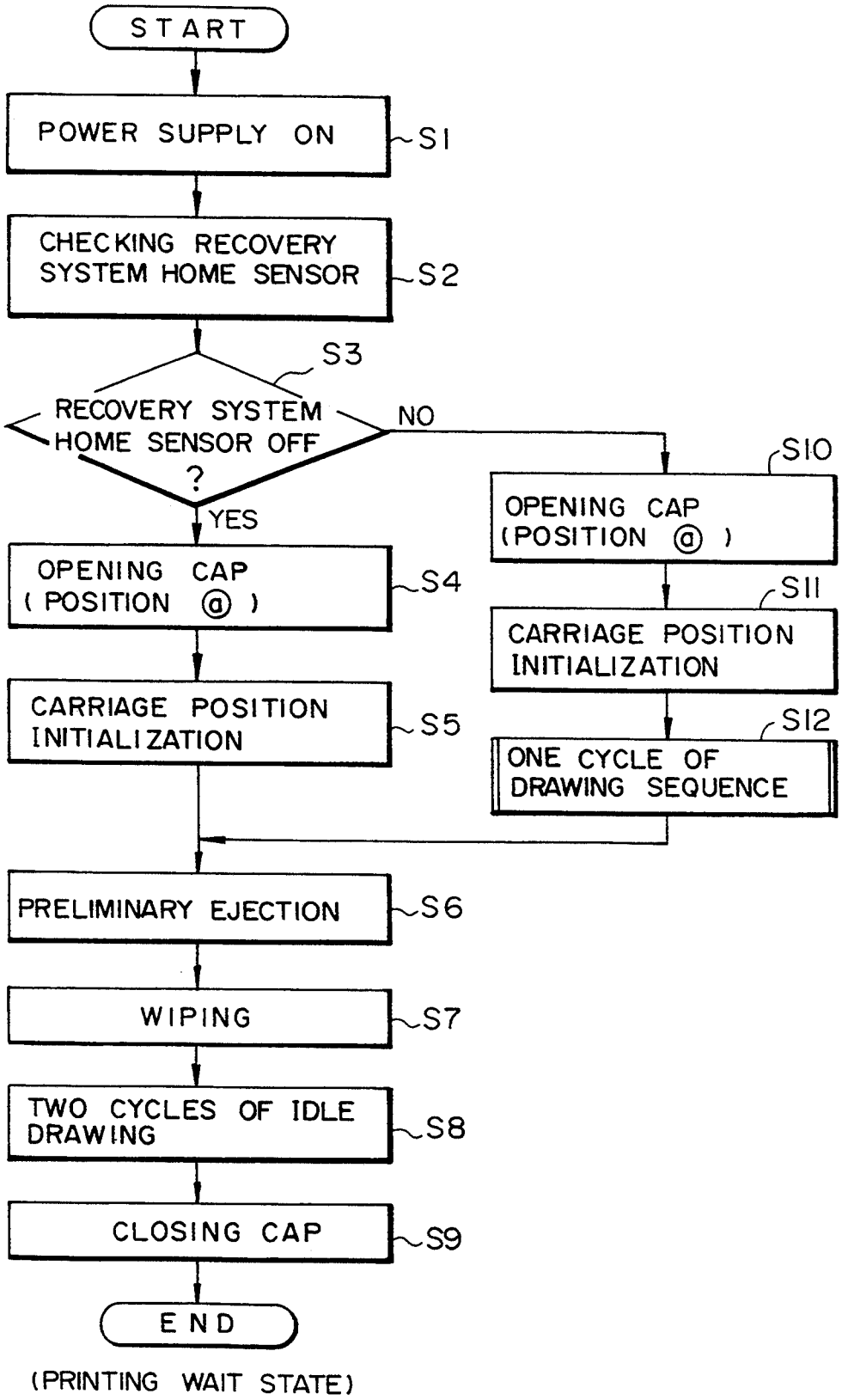
FIG. 9 is a flow chart of the control procedure of an example of an ejection recovery process in accordance with one embodiment of the present invention.

FIG. 9 is a flowchart showing the control procedure of the head ejection recovery process performed when the power source is turned on. The power source of the recording apparatus is turned on in step S1, and the control means 999 detects the on/off state of the recovery system home sensor 65. If it is thereby determined that the sensor is off (Yes in step S3), it is considered that the head is capped with the cap 51 as shown in FIG. 5, and the process proceeds to step S4 to rotate the cam device 63 from the position (b) to the position (a) (0°) shown in FIG. 5 by driving the recovery system motor 61, so that the cap 51 is separated from the ejection hole formation surface 9a (the cap is opened) to prepare for the movement of the carriage 11. At this time, since the position of the cam device 63 in the range of 36.6° to 140.0° is unknown, the recovery system motor 61 may be driven so that the cam device is rotated by −36.6° from the position at which the recovery home sensor 65 is changed from the off state to the on state.

Then, in step S5, the position of the carriage 11 is initialized by moving the carriage 11 to the position of the carriage home sensor 67, checking this sensor, and thereafter returning the carriage 11 to the cap position. Next, in step S6, preliminary ejection is performed for the purpose of making the state of ink at the ink ejection holes **9*b* optimal for printing. That is, 100 shots of preliminary ejection are made from all the ejection holes (64 holes) of the head 9 into the cap 51 in the off state. In step S7, wiping is performed to remove ink, extraneous matter, dust and the like attached to the ink ejection holes 9*b* of the head 9 and portions in the vicinity of the holes with the blade 59. That is, at the position (f) shown in FIG. 5, i.e., the position at which the blade 59 contacts the ejection holes 9*b* of the head, the carriage 11 is driven laterally to wipe off ink, extraneous matter, dust and the like with the blade 59**.

In step S8, idle drawing is performed to draw the ink introduced into the cap 51 by the preliminary ejection. That is, the piston 525 is made to advance and return for two cycles in the vicinity of the position (e) shown in FIG. 5 to draw ink remaining in the cap 51 into the pump 53. In step S9, the cam device is driven to the position (b) shown in FIG. 5, and the head is capped with the cap 51, thereby setting the apparatus in a printing wait state.

If it is determined in step S3 that the recovery system home sensor is on, it is considered that the head is not capped with the cap 51 as can be understood from FIG. 5, and the ejection recovery operation using the pump in accordance with an ink drawing sequence is performed one time to recover the ink ejection holes **9*b* of the head from a clogged state, as described below. First, if it is determined that the recovery system home sensor 65 is on (No in step S3), the process proceeds to step S10 to rotate the cam device 63 to the position (a) (0°) shown in FIG. 5 by driving the recovery system motor 61, so that the cap 51 is separated from the ejection hole formation surface 9*a* (the cap is opened) to prepare for the movement of the carriage 11**.

At this time, since the position of the cam device 63 in the range of 0° to 360° is unknown, the recovery system motor 61 may be driven so that the cam device is rotated by −36.6° from the position at which the recovery home sensor 65 is changed from the off state to the on state.

Then, in step S11, the position of the carriage 11 is initialized by moving the carriage 11 to the position of the carriage home sensor 67 and thereafter returning the carriage 11 to the cap position. Next, in step S12, the drawing sequence is performed for forcibly drawing and discharging, from the ink ejection holes **9*b*, an amount of ink which has an increased viscosity and thus can adversely influence the ejection. The drawing sequence is performed one time, by operating the pump 53 while covering the ejection hole formation surface 9*a*** of the head with the cap to recover the ink ejection holes of the head from the clogged state.

Figure 10:
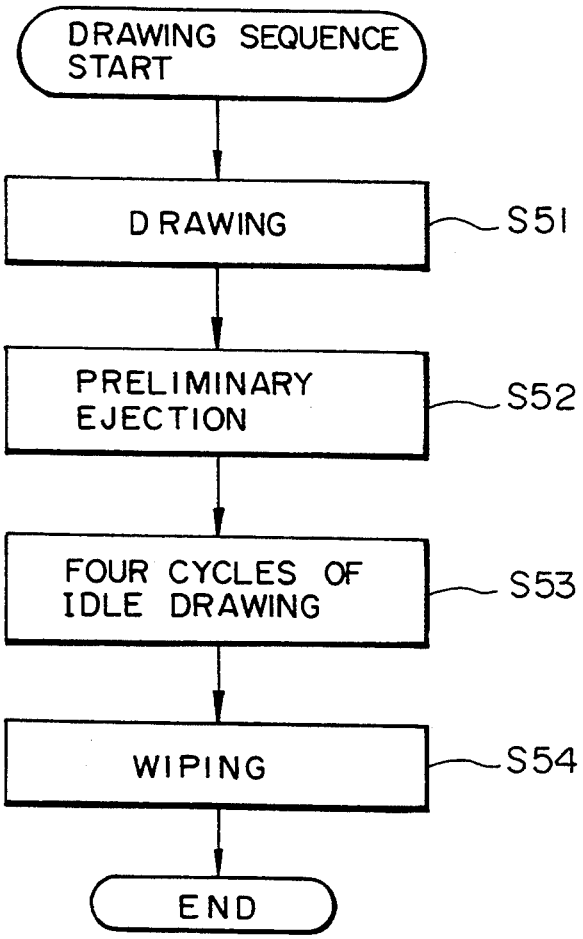
FIG. 10 is a flowchart of an ink drawing sequence.

The content of the drawing sequence of step S12 is represented by the flowchart of FIG. 10. In step S51, the pump 53 is operated to draw ink. That is, the cam device 63 is rotated from the position (b) shown in FIG. 5 to the position (c), to the position (b) and to the position (a).

In step S52, preliminary ejection is performed for the purpose of making the state of ink at the ejection ends of the ink ejection holes **9*b* optimal for printing. In step S53, idle drawing is performed four times to draw an amount of ink attached to the cap 51 by the preliminary ejection. That is, idle drawing based on making the piston 525 advance and return for two cycles in the vicinity of the position (e) shown in FIG. 5 to draw ink remaining in the cap 51 to the pump 53 is performed four times. Thereafter, in step S54, wiping for removing ink, extraneous matter, dust and the like with the blade 59 is performed by laterally driving the carriage 11 at the position (f) shown in FIG. 5, i.e., the position at which the blade 59 contacts the ejection holes 9*b*** of the head. The drawing sequence is completed by these steps.

Next, the process proceeds through steps S6 to S8, and to step S9 as in the above to set the apparatus in the printing wait state. As described above, if the head is capped with the cap 51 when the power source is turned on, the drawing sequence is not executed, so that wasteful ink consumption is prevented. On the other hand, if the head is not capped, the drawing sequence is executed to avoid ink ejection failure or malfunction of the ejection holes.

SECOND EMBODIMENT

The second embodiment of the present invention will be described below. In this embodiment, the elapsed time is measured from the time a preceding recovery operation was performed to the time when the power source is again turned on. The open/close state of the cap is detected and the ejection recovery means is controlled according to the elapsed time.

Figure 11:
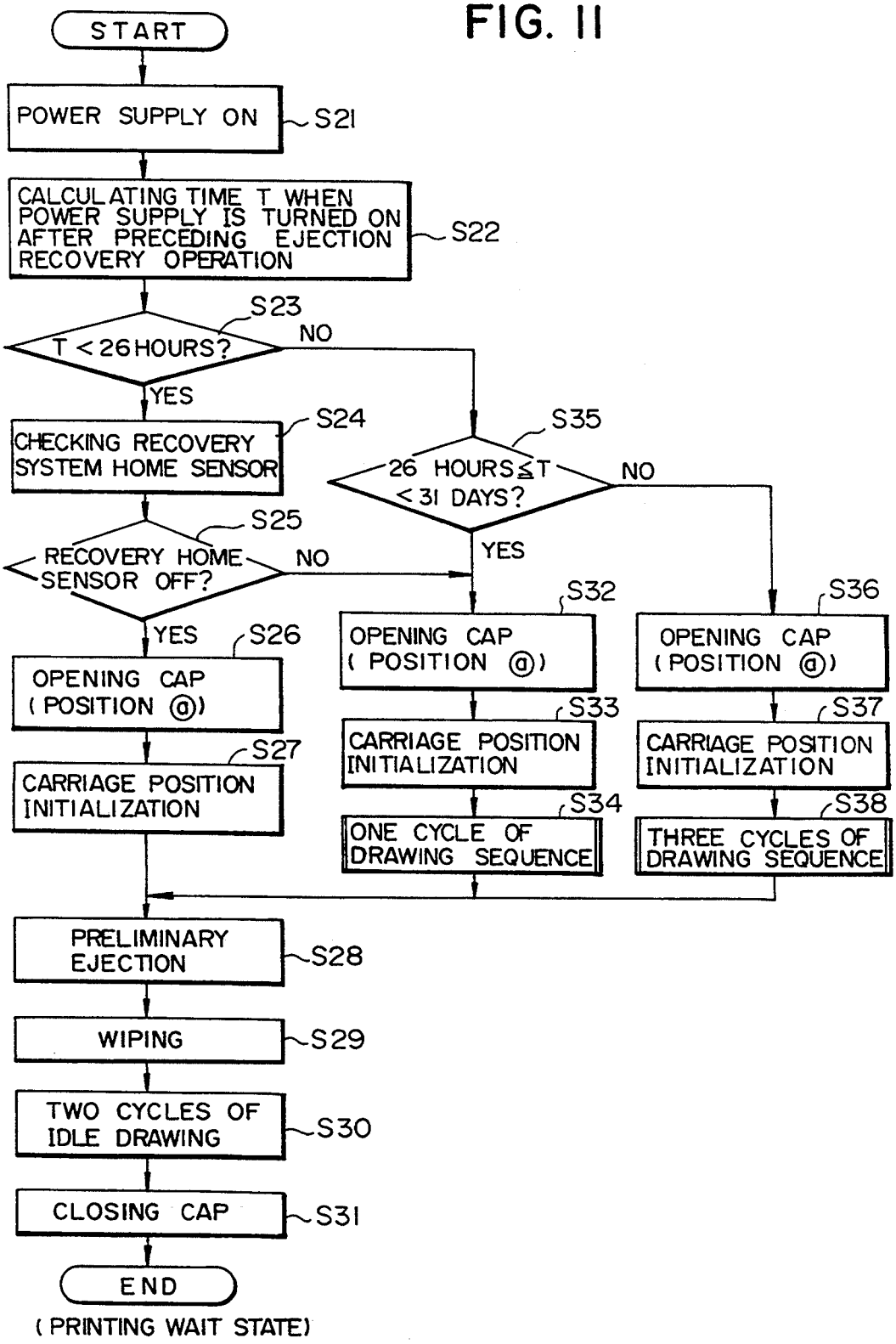
FIG. 11 is a flow chart of the control procedure of an example of an ejection recovery process in accordance with another embodiment of the present invention.

FIG. 11 shows a control procedure for the ejection recovery process performed when the power source is turned on in an ink jet recording apparatus in accordance with this embodiment. In step S21, the power source is turned on. In step S22, the period of time T between the time when a preceding ink drawing ejection recovery operation was performed and the time when the power source was thereafter turned on is calculated by the control means 999 based on the time counted by the timer 1005. In step S23, determination is made as to whether $T<26$ hours. If Yes, the control means 999 detects the on/off state of the recovery system home sensor 65 in step S24.

If it is thereby determined that the sensor is off (Yes in step S25), it is considered that the head is capped as can be understood from FIG. 5, and the process proceeds to step S26 to rotate the cam device 63 from the position (b) to the position (a) (0°) shown in FIG. 5 by driving the recovery system motor 61, so that the cap 51 is separated from the ejection hole formation surface **9*a* (the cap is opened) to prepare for the movement of the carriage 11**.

Then, in step S27, the position of the carriage 11 is initialized by moving the carriage 11 to the position of the carriage home sensor 67 and thereafter returning the carriage 11 to the cap position. Next, in step S28, preliminary ejection is performed for the purpose of making the state of ink at the ink ejection holes **9*b* optimal for printing, as in the case of the first embodiment. In step S29, wiping is performed to remove ink, extraneous matter, dust and the like attached to the ink ejection holes 9*b* of the head 9 and portions in the vicinity of the holes with the blade 59**.

In step S30, idle drawing is performed to draw ink introduced into the cap 51 by the preliminary ejection. In step S31, the cam device is driven to the position (b) shown in FIG. 5, and the head is capped with the cap 51, thereby setting the apparatus in the printing wait state.

If it is determined in step S25 that the recovery system home sensor is on, it is considered that the head is not capped as can be understood from FIG. 5, and the ink drawing operation is performed one time as an ejection recovery operation by using the pump to recover the ink ejection holes 9*b* of the head from a clogged state, as in the case of the first embodiment. For this operation, if it is determined that the recovery system home sensor 65 is on (No in step S25), the process proceeds to step S32 to rotate the cam device 63 to the position (a) (0°) shown in FIG. 5 by driving the recovery system motor 61, so that the cap 51 is separated from the ejection hole formation surface 9*a* (the cap is opened) to prepare for the movement of the carriage 11.

Then, in step S33, the position of the carriage 11 is initialized by moving the carriage 11 to the position of the carriage home sensor 67 and thereafter returning the carriage 11 to the cap position. In step S34, the drawing sequence is performed for forcibly drawing and discharging, from the ink ejection holes 9*b*, an amount of ink which has an increased viscosity and thus can adversely influence the ejection. The drawing sequence is performed one time, by operating the pump 53 while covering the ejection hole formation surface 9*a* of the head with the cap to recover the ink ejection holes of the head from the clogged state. Thereafter, the process proceeds through steps S28 to S31 to perform the same process as steps S6 to S9 of the first embodiment, thereby setting the apparatus in the printing wait state.

If No in step S23, the process proceeds to step S35 to determine whether 26 hours$\leqq$T$<$31 days. In the case of Yes, the process proceeds in the order of step S32→S33→S34→S28→S29→S31 for processing, as above. In this case, the drawing sequence is performed one time because 26 hours$\leqq$T$<$31 days and it is possible that ink has become unsuitable for recording.

If No in step S35, that is, T$\geqq$31 days, the process proceeds to step S36 to rotate the cam device 63 to the position (a) (0°) shown in FIG. 5 by driving the recovery system motor 61, so that the cap 51 is separated from the ejection hole formation surface 9*a* (the cap is opened) to prepare for the movement of the carriage 11.

In step S37, the position of the carriage 11 is initialized by moving the carriage 11 to the position of the carriage home sensor 67 and thereafter returning the carriage 11 to the cap position. In step S38, the drawing sequence is performed three times. That is, ink is repeatedly drawn to insure recovery of the ink ejection holes from a clogged state in consideration that T$\geqq$31 days.

Thereafter, the process proceeds through steps S28 to S31 for the same processing as above, thereby setting the apparatus in the printing wait state.

In the second embodiment, the open/close state of the cap is detected to determine whether or not the ink drawing of the ejection recovery process will be performed, only when the time between a previous ink drawing of the ejection recovery process was performed and the time when the power source is again turned on is shorter than 26 hours. Accordingly, the drawing sequence is not performed as long as the head is capped when the power source is turned on and the state of ink is suitable for recording. The problem of useless consumption of ink is thereby avoided. If 26 hours$\leqq$T$<$31 days, the ink drawing sequence is executed one time irrespective of the open/close state of the cap. If T$\geqq$31 days, the ink drawing sequence is executed three times.

When T exceeds a predetermined period of time, it is possible that the ink has become unsuitable for recording, even if the ejection hole formation surface is covered with the cap when the power source is turned on. Under such a condition, therefore, the drawing sequence is always executed, and the number of times that the drawing sequence is executed is changed according to the time T. It is thereby possible to avoid ink ejection failure or malfunction of the ejection holes with high accuracy.

Other examples of the means for discriminating the capped state of the head will be described below. In the above-described embodiments, a contact switch is used as recovery system home sensor 65. Instead of the contact switch, a reflection type or transmission type photointerrupter may be used to discriminate the capped state of the head.

The discrimination means may be arranged without a contact switch or the like in such a manner that, for example, the cam device 63 is reversely rotated when the power source is turned on to be brought into contact with a rotation stop member, such as a projection, separately provided on the apparatus body at the position of 0° shown in FIG. 5. The number of steps of the recovery system motor 61 before the contact is detected and compared with the number of steps for reversely rotating the cam device 63 from the position at which the head is capped to the position at which the cam device 63 is brought into contact with the rotation stop member. The position of the cam device 63 before the power source is turned on is detected in this manner to discriminate whether or not the head is capped. To detect the contact between the cam device 63 and the rotation stop member, a change in the current flowing through the recovery system motor 61 when the condition of the recovery system motor 61 is correspondingly changed may be detected.

Figure 12:
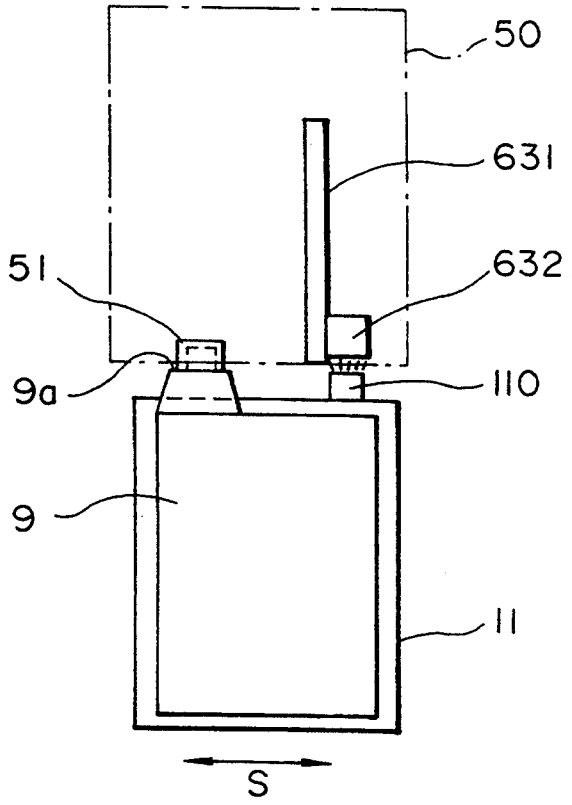
FIG. 12 is a top view of the recovery system unit and the carriage when the head is capped.
Figure 13:
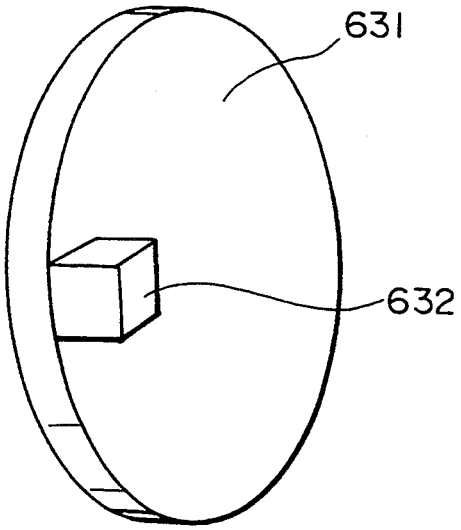
FIG. 13 is a perspective view of a disk of the recovery system unit.

Another example of the means for discriminating the capped state of the head will be described below. FIG. 12 is a top view of a recovery system unit 50 and the carriage 11 when the head is capped, and FIG. 13 is a perspective view of a disk 631 provided in the recovery system unit 50. The carriage 11 is moved in the direction of the arrow S for scanning. The axis of the cam device 63 shown in FIG. 3 is coaxially connected to the center axis of the disk 631. A sense plate 632 is provided as a projection on the disk 631. The arrangement is such that a paper sensor 110 on the carriage detects the sense plate 632 only when the head is capped. In this example, the state in which the ejection hole formation surface 9*a* is capped or not capped with the cap 51 can be discriminated according to whether the paper sensor 110 detects the sense plate 632 when the power source is turned on.

Figure 14:
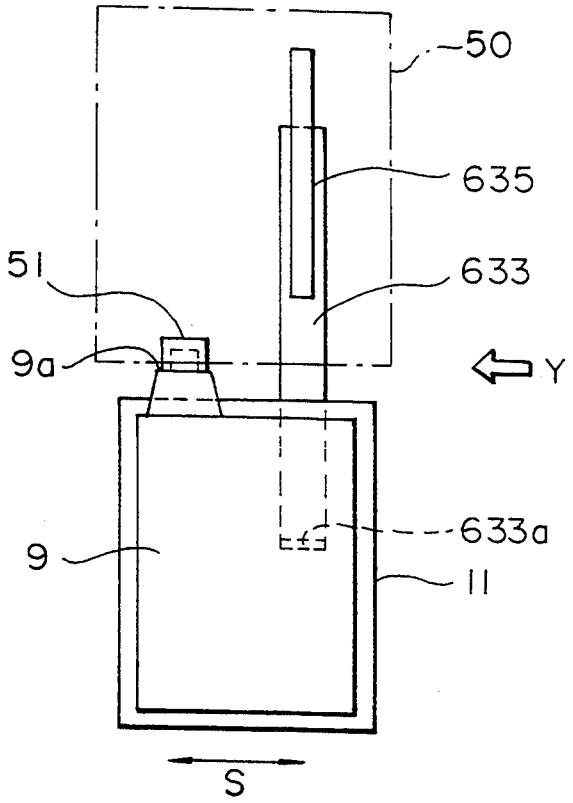
FIG. 14 is a top view of the recovery system unit and the carriage when the head is capped.
Figure 15:
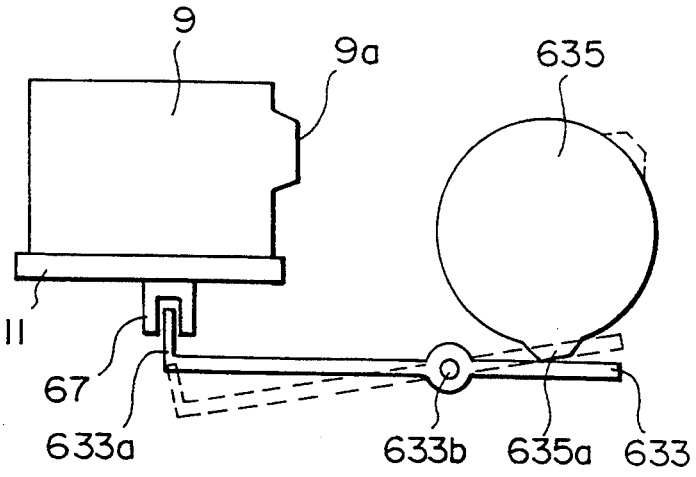
FIG. 15 is a diagram of the same components as FIG. 13 seen in the direction Y of Fig, 14.

A further example of the discrimination means will be described below. FIG. 14 is a top view of the recovery system unit 50 and the carriage 11 when the head is capped, and FIG. 15 is a side view of this arrangement seen in the direction of arrow Y of FIG. 14. In this example as well, there is no need for recovery system home sensor 65. The direction of scanning of the carriage 11 is indicated by the arrow S in FIG. 14. A disk 635 is provided in the recovery system unit 50. The axis of the cam device 63 shown in FIG. 3 is coaxially connected to the center axis of the disk 635. A projection 635*a* is provided on an outer circumferential surface of the disk 635. The projection 635*a* can force a sense bar 633 to upwardly move a shielding plate 633*a* provided on the sense bar 633 so as to shield the carriage home sensor provided on the carriage 11 (as illustrated with the solid lines in FIG. 15). The sense bar 633 is rotated on an axis 633*b*.

In a state where the head is not capped, the sense bar 633 is in the state illustrated with the solid line in FIG. 15. In this arrangement, the capped/uncapped state of the head is discriminated according to whether or not the shielding plate 633*a* is detected with the carriage home sensor 67.

In a still further example of the discrimination means, a drive source constituted of, for example, a lead screw, is used for the carriage and it is also used to drive the recovery system. The amount of driving of the motor for rotating the lead screw is detected to know the position of the carriage and the operating state of the recovery system, thereby enabling the discrimination as to whether or not the nozzle portion of the head is capped.

The ejection recovery process discussed above, performed if the head is not capped when the power source is turned on, need not be performed immediately after turning on the power source. It may be performed immediately before printing is first started after the power source has been turned on.

The particular ejection recovery process performed by the ejection recovery means in accordance with the present invention is not limited to the one described above with respect to the embodiments, in which ink in the ejection holes is drawn to effect ink ejection recovery, and any other ejection recovery methods can be applied.

The present invention is particularly advantageous when applied to a recording head and a recording apparatus using a type of ink jet system in which flying liquid droplets are formed by using thermal energy to perform recording.

As such a recording system, a system the typical construction and the principle of which are described in U.S. Pat. Nos. 4,723,129, and 4,740,796 is preferred. This recording system may be applied as an on-demand type or a continuous type. An on-demand type thermal ink jet recording system, however, is particularly effective because at least one driving signal can be applied to each of electrothermal conversion elements disposed in correspondence with a sheet or liquid paths in which a liquid (ink) is retained. The driving signal will cause an abrupt increase in temperature exceeding a nucleate boiling point in accordance with recording information; that is, it will generate thermal energy in the electrothermal conversion element sufficient to cause film boiling at a heat application surface of the recording head, so that a bubble can be formed in the liquid (ink) in a one-to-one relationship with this driving signal. The bubble is increased and reduced in volume so that the liquid (ink) is jetted through the ejection hole to form at least one droplet. If the driving signal is formed so as to have a pulse-like shape, the increase and the reduction in the volume of each bubble can be caused suitably and rapidly. It is thereby possible to achieve a liquid (ink) ejection effect particularly improved in response.

As such a pulse driving signal, those described in U.S. Pat. Nos. 4,463,359 and 4,345,262 can be suitably used. If the condition of the temperature rising rate of the heat application surface described in U.S. Pat. No. 4,313,134 is adopted, further improved recording performance can be achieved.

Recording head constructions based on those described in U.S. Pat. Nos. 4,558,333 and 4,459,600, in which each heat application portion is placed in a bent region, may be applicable, as well as constructions based on the combinations of ejection holes, liquid paths and electrothermal conversion elements (forming linear liquid paths or rectangular liquid paths) as described in the above-mentioned patents.

In addition, constructions based on that disclosed in Japanese Patent Laid-Open Publication No. 59-123670, in which a common slit is used as a section for ejection from electrothermal conversion elements, and that disclosed in Japanese Patent Laid-Open Publication No. 50-138461, in which holes for absorbing pressure waves caused by thermal energy are formed in correspondence with ejection sections, may be adopted.

A full-line type recording head having a length corresponding to the width of a maximum-size recording medium sheet available for recording in the recording apparatus is also applicable to the present invention. Such a head may have a construction, such as that described in the above-mentioned patents, in which a plurality of recording heads are combined to cover the desired length, or the construction of one integrally-formed recording head.

The recording head used in accordance with the present invention may also be constructed as an interchangeable chip-type recording head capable of being electrically connected to a main body of the apparatus and being supplied with ink from the main body when attached to the main body, or a cartridge-type recording head integrally combined with an ink tank.

The recording apparatus may also be arranged to have recording modes for multi-color recording or full-color recording based on mixing a plurality of colors, as well as a recording mode using only one main color such as black. This arrangement may be achieved by using one integrally formed recording head or a combination of a plurality of recording heads.

The embodiments of the present invention have been described by considering ink as a liquid. However, an ink used in accordance with the present invention may be one capable of being softened or liquefied at room temperature, or one capable of being liquefied when an operating recording signal is applied, since in the above-mentioned ink jet recording systems the temperature of ink is controlled ordinarily in the range of 30° to 70° C. so that the viscosity of the ink is within a stable ejection range.

Also, a type of ink which is used in such a manner that the increase in temperature caused by thermal energy is limited by being positively utilized as energy for the change of the ink from a solid state to a liquid state may be selected, or a type of ink solidified when left unused may be selected for the purpose of preventing ink evaporation. That is, inks having a property such that they are liquefied only when thermal energy is applied, for example, inks that are liquefied by application of thermal energy in accordance with a recording signal to be ejected as liquid ink and inks capable of beginning to solidify at the time of reaching the recording medium, are also applicable to the present invention. Such an ink may be used in such a manner as to face electrothermal conversion elements while being retained as a liquid or a solid material in recesses in a porous sheet or through holes as described in Japanese Patent Laid-Open Publication No. 54-56847 or U.S. Pat. No. 4,608,577. In accordance with the present invention, the film boiling method is used most effectively with respect to each of the above-described inks.

The recording apparatus in accordance with the present invention may be used in the form of a unit integrally or separately provided as an image output terminal of an information processor, such as a word processor or a computer, a copying unit combined with a reader, or a facsimile machine having transmitting and receiving functions.

Figure 16:
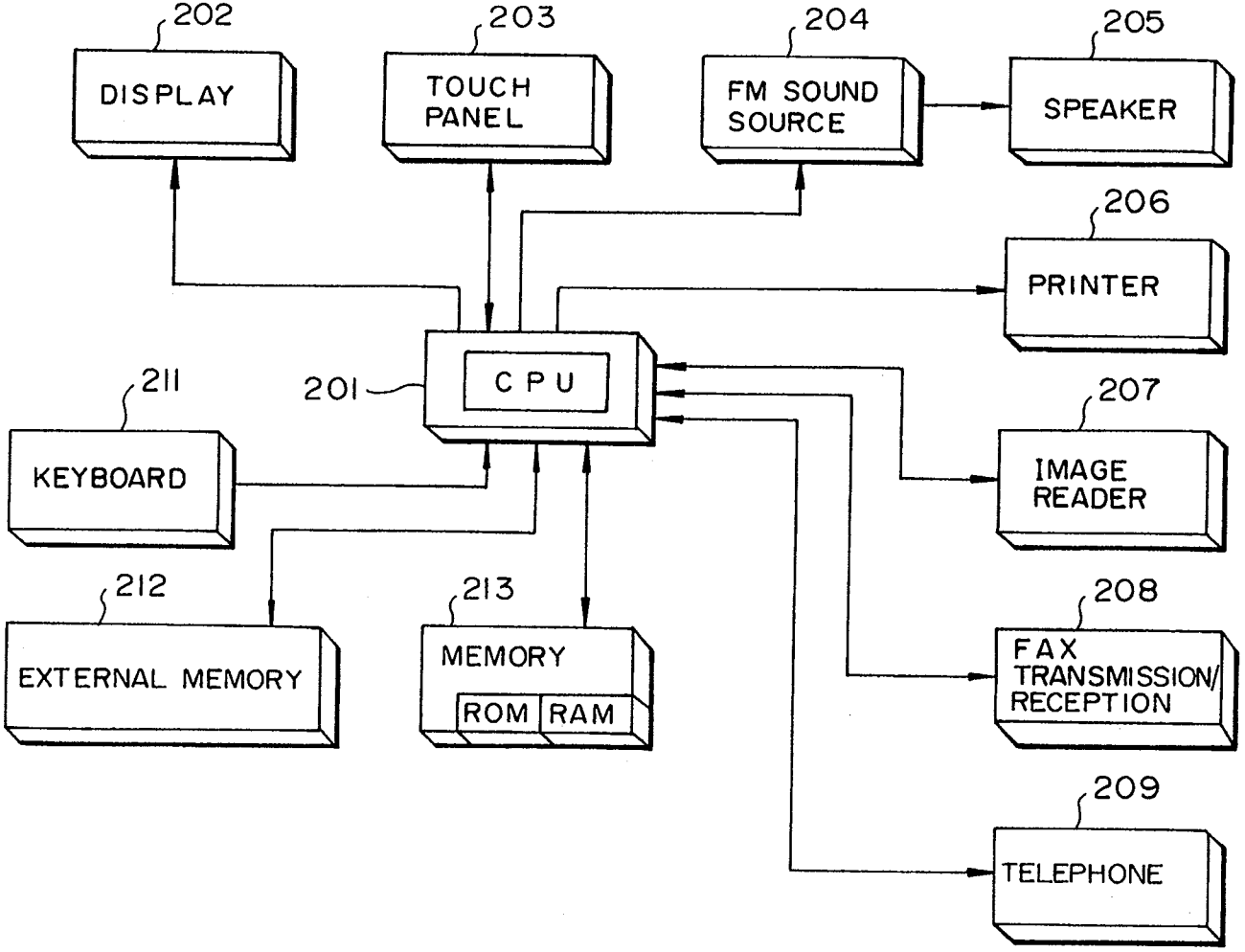
FIG. 16 is a block diagram schematically showing the construction of an information processor to which the recording apparatus of the present invention is applied.

FIG. 16 is a block diagram schematically showing the construction of an information processor having functions of a word processor, a personal computer, a facsimile machine and a copying machine to which the recording apparatus of the present invention is applied. A block 201 represents a control unit which has overall control of the information processor and which has a CPU constituted of a microprocessor or the like, and various I/O ports. The control unit 201 controls other components by outputting control signals, data signals and the like to the other components and receiving control signals and data signals therefrom. A block 202 represents a display unit having a display screen on which various menus, document information and image data read with an image reader 207 are displayed. A block 203 represents a transparent pressure-sensitive touch panel provided over the display unit 202. Data item inputting and coordinate position inputting through the display unit 202 can be performed by pressing a surface of the touch panel 203 with a finger or the like.

A block 204 represents a frequency modulation (FM) sound source. Music information prepared with a music editor is stored as digital data in a memory 213 or an external memory 212 and is read therefrom to be FM-modulated by the FM sound source 204. An electrical signal from the FM sound source 204 is converted into an audible sound by a speaker 205. A printer unit 206 is an output terminal for a word processor, a personal computer, a facsimile machine and a copying machine to which the recording apparatus in accordance with the present invention is applied.

A block 207 represents an image reader unit for photoelectrically reading an original and inputting read original data. The image reader unit 207 is provided at an intermediate portion of an original transport path. The image reader unit 207 reads facsimile originals, originals to be copied and other various kinds of originals. A block 208 represents a facsimile transmission/-reception unit which serves for facsimile transmission of original data read by the image reader unit 207 and which receives a transmitted facsimile signal and decodes the received signal. Facsimile transmission/-reception unit 208 functions as an interface with an external terminal. A block 209 represents a telephone unit having various telephone functions such as an ordinary telephone function and a message recording function. The memory unit 213 includes a ROM for storing a system program, a manager program, application programs, character fonts, dictionaries, and other categories of data, and a RAM for storing application programs, character information, video data and other categories of data loaded from the external memory 212.

A block 211 represents a keyboard unit for inputting document information and various kinds of commands. The external memory unit 212 uses a floppy disk, hard disk or the like as a memory medium, and character information, music or sound information, user's application programs, and the like are stored in the external memory unit 212.

Figure 17:
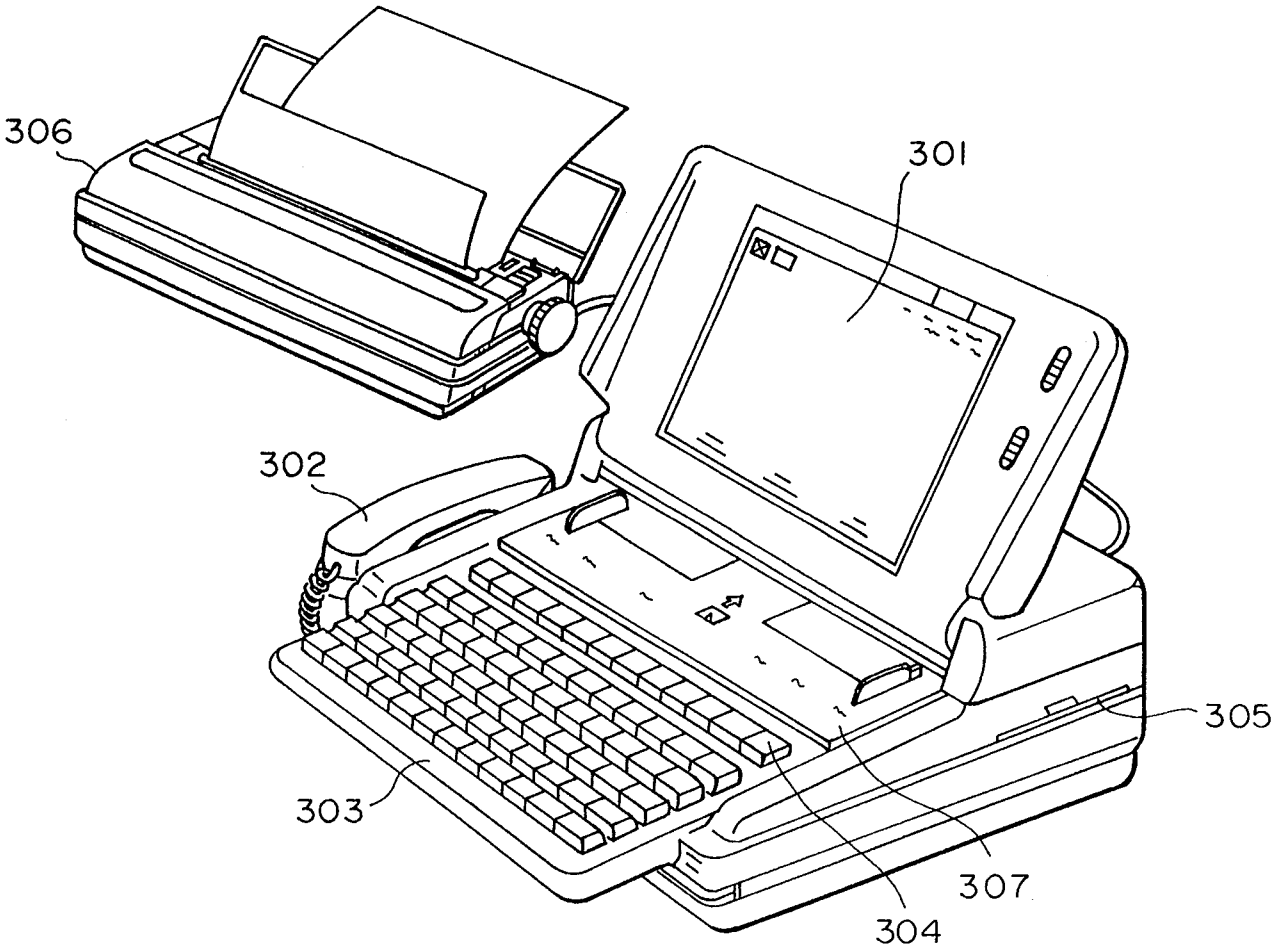
FIG. 17 is a diagram of the information processor shown in FIG. 16.

FIG. 17 is a diagram showing the appearance of the image processor shown in FIG. 16. On a flat display panel 301 using a liquid crystal or the like, various menus, drawing information, document information and other categories of information are displayed. The touch panel is placed on the display panel 301. Coordinate inputting and item designation inputting can be performed by pressing the surface of the touch panel. A handset 302 is used when the information processor functions as a telephone.

The keyboard 303 is detachably connected to the main body through a code and is capable of inputting various kinds of character information and various categories of data. Various function keys 304 are provided on the keyboard 303. A floppy disk insertion port is formed as indicated at 305.

An original to be read by the image reader 207 is placed on a paper placement portion 307. The read original is discharged through a rear portion of the information processor. At the time of facsimile reception, received information is recorded by an ink jet printer 306.

The display 301 may be a CRT. However, a flat panel display such as a liquid crystal display utilizing a ferroelectric liquid crystal is particularly preferred as display 301, because it can be reduced in size, thickness and weight. When the information processor functions as a personal computer or a word processor, various information items input through the keyboard unit 211 as shown in FIG. 16 are processed by the control unit 201, in accordance with a predetermined program, to be output as an image through the printer unit 206. When the information processor functions as a receiver of a facsimile machine, facsimile information input through the facsimile transmission/reception unit 208 is received and processed by the control unit 201, in accordance with a predetermined program, to be output as a received image through the printer unit 206.

Figure 18:
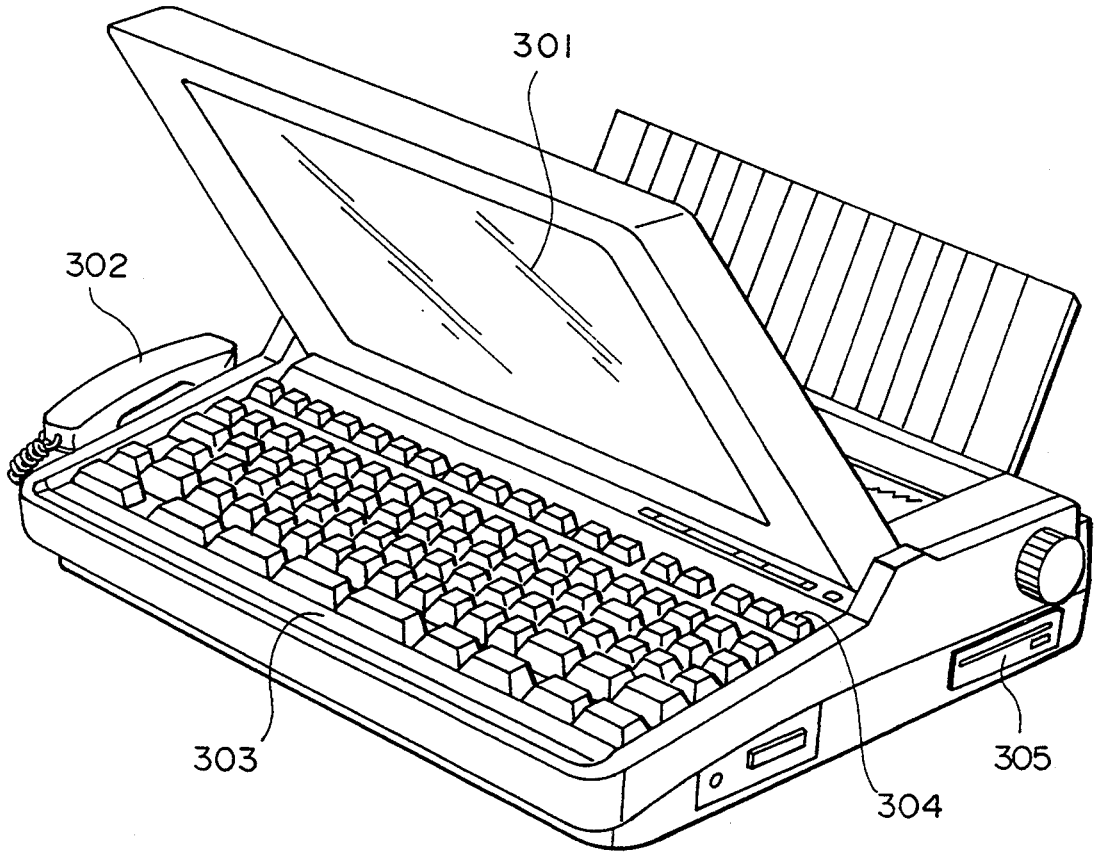
FIG. 18 is a diagram of another example of the information processor.

When the information processor functions as a copying machine, an original is read by the image reader unit 207, and the read original data is supplied as a copied image to the printer unit 206 through the control unit 201. When the information processor functions as a transmitter of a facsimile machine, original data read by the image reader unit 207 is processed by the control unit 201 in accordance with a predetermined program to be transmitted through a communication line by the facsimile transmission/reception unit 208. The above-described information processor may be constructed as one integral unit having an ink jet printer in the main body as shown in FIG. 18. In this case, the portability can be improved. In FIG. 18, components having the same functions as those shown in FIG. 17 are indicated by the same reference characters.

By the application of the recording apparatus of the present invention to the above-described multi-function type information processor, a high-quality recorded image can be obtained and the functions of the information processor can be improved.

In accordance with the present invention, embodiments of which are described above in detail, the ink jet recording apparatus is controlled in such a manner that the ejection recovery means performs an ejection recovery operation if the detection means detects an open state of the cap means, state in which the cap means is not covering the nozzle of the recording head when the power source of the ink jet recording apparatus is turned on, and an ejection recovery operation is not performed by the ejection recovery means if the detection means detects a closed state of the cap means, in which the cap means is covering the nozzle of the recording head when the power source is turned on. Accordingly, if the operator cuts off the power supply during recording or when the recording head is not covered tightly by the cap, then leaves the apparatus in this state for a long time and thereafter starts recording, the head ejection recovery process is automatically performed to avoid ink droplet ejection failure or malfunction of the nozzle, thereby enabling suitable image recording. On the other hand, the apparatus is also arranged to have a mode in which the ejection recovery process is inhibited if the recording head is tightly capped when the power source is turned on, thereby avoiding wasteful ink consumption causes by performing an unnecessary recovery operation.

While the present invention has been described with respect to what presently are considered to be preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An ink jet recording apparatus for recording using a recording head for ejecting ink onto a recording medium through a nozzle of the recording head, said apparatus comprising:

cap means for assuming an open state exposing the nozzle of the recording head to atmosphere and a closed state covering the nozzle of the recording head;

ejection recovery means for performing an ejection recovery operation on the recording head to recover the ink ejection from the nozzle;

time count means for counting a time elapsed from the ejection recovery operation;

detection means for detecting the state of said cap means if the time elapsed from a preceding ejection recovery operation to a time a power source for the recording apparatus is turned on is shorter than a predetermined length of time; and control means for controlling said ejection recovery means so that the ejection recovery operation is performed if said detection means detects that said cap means is in the open state when the power source is turned on, and for controlling said ejection recovery means so that the ejection recovery operating is not performed if said detection means detects that said cap means is in the closed state when the power source is turned on.

2. An ink jet recording apparatus according to claim 1, wherein the ejection recovery operation includes drawing the ink through the nozzle of the recording head.

3. An ink jet recording apparatus according to claim 1, wherein said control means controls said ejection recovery means so that the ejection recovery operation is performed if the time elapsed from the preceding recovery operation to the time the power source is turned on is equal to or longer than the predetermined length of time.

4. An ink jet recording apparatus according to claim 1, wherein the recording head includes a thermal energy conversion element for generating thermal energy to be applied to the ink to eject the ink through the nozzle.

5. An ink jet recording apparatus according to claim 4, wherein the recording head ejects ink through the nozzle by utilizing a change in a state of the ink caused by the thermal energy applied by said thermal energy conversion element.

6. An ink jet recording apparatus to claim 1, further comprising an image reader unit and a control unit.

7. An ink jet recording apparatus according to claim 1, further comprising a communication unit for communication with an external terminal.

8. An ink jet recording apparatus according to claim 1, further comprising an image reader unit, a control unit and a facsimile transmission/reception unit.

9. An ink jet recording apparatus according to claim 1, further comprising an input unit, a control unit and a display unit.

10. An ink jet recording apparatus for recording using a recording head for ejecting ink onto a recording medium through a nozzle of the recording head, said apparatus comprising:

cap means for assuming an open state exposing the nozzle of the recording head to atmosphere and a closed state covering the nozzle of the recording head;

ejection recovery means for performing an ejection recovery operation on the recording head to recover the ink ejection from the nozzle;

detection means for detecting the state of said cap means; and control means for controlling said ejection recovery means so that the ejection recovery operation is performed if said detection means detects that said cap means is in the open state when a power source for the recording apparatus is turned on, and for controlling said ejection recovery means so that the ejection recovery operation is not performed if said detection means detects that said cap means is in the closed state when the power source is turned on.

11. An ink jet recording apparatus according to claim 10, wherein the ink ejection recovery operation includes drawing the ink through the nozzle of the recording head.

* * * * *

UNITED STATES PATENT AND TRADEMARK OFFICE

CERTIFICATE OF CORRECTION

PATENT NO. : 5,341,163

DATED : August 23, 1994

INVENTOR(S) : TADASHI HANABUSA

It is certified that error appears in the above-identified patent and that said Letters Patent is hereby corrected as shown below:

ON TITLE PAGE

In [56] References Cited, under U.S. PATENT DOCUMENTS: "5,583,333 12/1985 Sugitani et al." should read --4,558,333 12/1985 Sugitani et al.--.

COLUMN 1

Line 25, "Low" should read --low--.

COLUMN 2

Line 65, "capable" should read --capable of--.

COLUMN 3

Line 16, "the" should be deleted.

COLUMN 4

Line 64, "downstream" should read --downstream of--.

COLUMN 5

Line 4, "of" should read --or--.

COLUMN 7

Line 66, "510" should read --51.--.

UNITED STATES PATENT AND TRADEMARK OFFICE

CERTIFICATE OF CORRECTION

PATENT NO. : 5,341,163

DATED : August 23, 1994

INVENTOR(S) : TADASHI HANABUSA

It is certified that error appears in the above-identified patent and that said Letters Patent is hereby corrected as shown below:

COLUMN 8

Line 51, "ing," should read --ion,--.

COLUMN 17

Line 24, "causes" should read --caused--.

COLUMN 18

Line 24, "to" should read --according to--.

Signed and Sealed this

Seventeenth Day of January, 1995

*Attest:*

*Attesting Officer*

Bruce Lehman

BRUCE LEHMAN

*Commissioner of Patents and Trademarks*